United States Patent [19]

Gotman

[11] Patent Number: 4,991,473

[45] Date of Patent: Feb. 12, 1991

[54] ROTATING DRIVER WITH AUTOMATIC SPEED SWITCHING AND TORQUE LIMITING CONTROLS

[75] Inventor: Alexander Gotman, Redondo Beach, Calif.

[73] Assignee: Franklin S. Sax, Marina del Rey, Calif. ; Trustee for the Gotman Group

[21] Appl. No.: 369,329

[22] Filed: Jun. 21, 1989

Related U.S. Application Data

[62] Division of Ser. No. 64,182, Jun. 19, 1987, Pat. No. 4,869,139.

[51] Int. Cl.[5] ..... B25B 23/157; B25B 21/00

[52] U.S. Cl. ..... 81/475; 81/467; 81/57.14; 475/259

[58] Field of Search ..... 81/467, 473–476, 81/54, 57, 57.11, 57.14, 57.22, 57.3, 57.31; 74/751, 768; 173/12, 163

[56] References Cited

U.S. PATENT DOCUMENTS 3,739,659 6/1973 Workman, Jr. ..... 74/751

FOREIGN PATENT DOCUMENTS 2336477 2/1975 Fed. Rep. of Germany ..... 81/474

*Primary Examiner*—D. S. Meislin

*Attorney, Agent, or Firm*—Gene W. Arant

[57] ABSTRACT

A driver with automatic speed and torque switching including two different drive trains which operate in parallel and are driven at the same time by a motor. One drive train provides a high-speed output while the other provides a low-speed output. A single drive head for transmitting torque to the nut is normally coupled to the high-speed output, and not to the low-speed output. The machine operates initially at the high speed for the "free rotation" of the nut. When the nut contacts the surface of the structural body, the drive coupling to the high-speed output is disabled, and the low-speed output (which formerly was not coupled to the drive head) is not at the same time coupled to the drive head. The nut is then driven much more slowly but with a higher driving torque. Within the low-speed drive train there is included a friction clutch, and adjustement means for adjusting the level of torque at which it will slip. This clutch is therefore set for the predetermined counter-torque that is to cause driving rotation to be terminated.

3 Claims, 2 Drawing Sheets

ROTATING DRIVER WITH AUTOMATIC SPEED SWITCHING AND TORQUE LIMITING CONTROLS

This application is a division of my prior copending application Ser. No. 07/064,182 filed 06/19/87, now U.S. Pat. No. 4,869,139 issued Sept. 26, 1989.

INCORPORATION BY REFERENCE

In order to avoid the unnecessary repetition of subject matter, and in accordance with the practice autorized by the MANUAL OF PATENT EXAMINING PROCEDURE, Section 608.01(p), the entire description of the allowed application Ser. No. 07/064,182 filed 06/19/87, on which the issue fee has been paid, is incorporated herein by reference.

DRAWING SUMMARY

FIG. 1 is a longitudinal crss-section view of a complete machine in acordance with the present invention; and FIG. 2 is a longitudinal cross-sectional view of a modified form of the forward end of the machine, which provides a fully automatic switching action.

DETAILED DESCRIPTION

Figure 1:
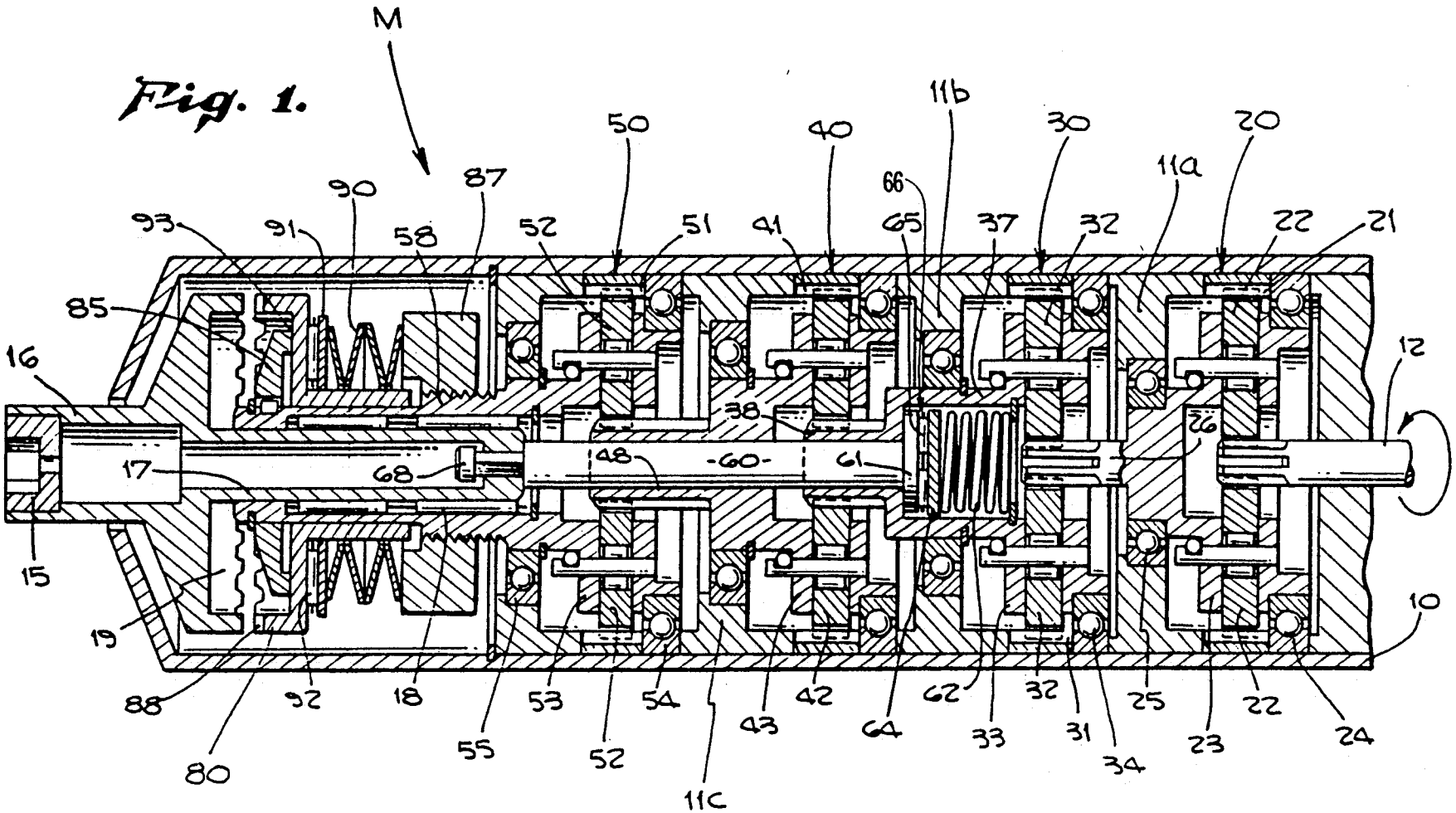

The present invention provides a machine for driving a nut first at a relatively high speed, then at a much lower speed but with higher driving torque, and then finally stopping its rotation altogether when a predetermined level of reaction torque is encountered. In the embodiment of FIG. 1, the nut is driven at high speed when running "free", but when it strikes the body against which it is to be tightened it is then necessary for the operator to press the machine forward in order to cause the desired speed shifting to occur. In the modification shown in FIG. 2 the machines itself accomplishes the desired speed shifting when this first level of reaction torque is encountered. In either embodiment, when the nut becomes tightened to the predetermined (second) level of reaction torque, the machine discontinues its driving action altogether.

Figure 2:
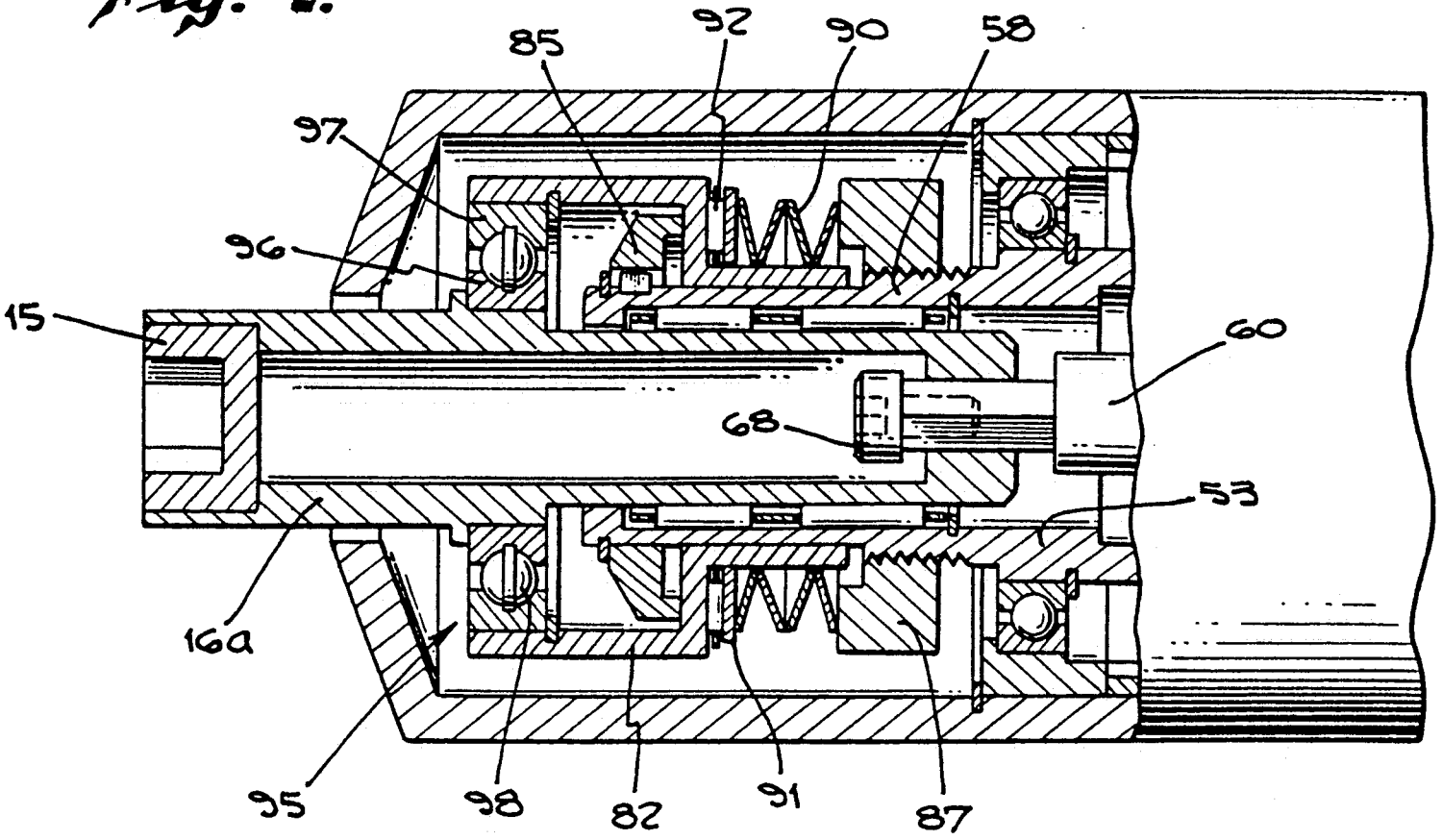

The outlines of the preferred embodiment of FIG. 2 are described as follows. A power input shaft 12 receives the rotating drive and applies it to a high-speed gear train which includes gear reduction stages 20 and 30, friction clutch 66, and high-speed shaft 60. High-speed shaft 60 is connected to drive head housing 16, 17, which constitutes a high-speed output for the high-speed drive train.

Rotating drive from input shaft 12 is concurrently imparted to a low-speed drive train which includes both the gear stages 20 and 30 and additional gear reduction stages 40 and 50. The low-speed drive train has a low-speed output shaft 58 to which a retainer plate 85 is connected.

Drive head 15 is adapted to be drivingly coupled to the nut. The high-speed drive train has its high-speed output connected to the drive head for rotating the nut at high speed, which occurs when the machine is first turned on and applied to a nut in the "free running" mode. An overrunning clutch 95 (shown only in FIG. 2) couples the low-speed output 58, 85, to the high-speed output 17. When the high-speed drive train is operating at high speed the overrunning clutch continuously slips, thus permitting the high-speed drive to be imparted to the nut.

The high-speed drive train also includes the friction clutch 66 having elements 37, 61, 62, 64, and 65. When the nut is rotating at high speed and a first level of increased reaction torque is encountered, this first friction clutch responds by continuously slipping so that the overrunning clutch then drivingly couples shaft 58 to the high-speed output 16, 17, and thereby drives the drive head 15 at the low speed.

The machine M also includes an additional friction clutch associated with the low-speed output 58, 85, and responsive to the predetermined (second) level of reaction torque for terminating the low-speed driven rotation of the drive head. This second friction drive train.

Rotating dirve from input shaft 12 is concurrently imparted to a low-speed drive train which includes both the gear stages 20 and 30 and additional gear reduction stages 40 and 50. The low-speed drive train has a low-speed output shaft 58 to which a retainer plate 85 is connected.

Drive head 15 is adapted to be drivingly coupled to the nut. The high-speed drive train has its high-speed output connected to the drive head for rotating the nut at high speed, which occurs when the machine is first turned on and applied to a nut in the "free running" mode. An overrunning clutch 95 (shown only in FIG. 2) couples the low-speed output 58, 85, to the high-speed output 17. When the high-speed drive train is operating at high speed the overrunning clutch continuously slips, thus permitting the high-speed drive to be imparted to the nut.

The high-speed drive train also includes the friction clutch 66 having elements 37, 61, 62, 64, and 65. When the nut is rotating at high speed and a first level of increased reaction torque is encountered, this first friction clutch responds by continuously slipping so that the overrunning clutch then drivingly couples shaft 58 to the high-speed output 16, 17, and thereby drives the drive head 15 at the low speed.

The machine M also includes an additional friction clutch associated with the low-speed output 58, 85, and responsive to the predetermined (second) level of reaction torque for terminating the low-speed driven rotation of the drive head. This second friction clutch includes elements 87, 90, 91, and 92 as shown in the embodiments of both FIG. 1 and FIG. 2.

The mechanism associated with the first frictin clutch 66 shown in FIG. 1 is of particular interest. It includes a first planetary gear reduction stage 30 having a sun gear 26 and satellite gears 32, a hollow shaft 37 connected to the centers of those satellite gears, the hollow shaft being externally toothed at 38, and an additional planetary reduction stage 40 that forms a part of the low-speed drive train. The hollow shaft 37, 38, provides the sun gear of the planetary gear reduction stage 40. The high-speed shaft 60 extends concentricaly through the hollow shaft 37, 38, and the friction clutch 66 has elements 37, 61, 62, 64, and 65, and couples the hollow shaft to the high-speed shaft. Helical compression spring 62 forces pressure plate 64 against a needle thrust bearing 65 which pushes the flat circular head 61 of shaft 60 against a flat, radially extending end wall of the hollow cylinder 37. The spring-loaded contact of shaft head 61 against the end wall of cylinder 37 provides sufficient friction for driving the nut during its "free" rotation at the relatively high speed.

I claim:

1. A machine for driving a nut first at a relatively high speed, then at a much lower speed but with higher driving torque, and then finally stopping its rotation altogether when a predetermined level of reaction torque is encountered in the nut, said machine comprising:

a rotatably driven power input shaft;

first gearing coupled to said power input shaft, said first gearing including a first planetary gear reduction stage having a sun gear and satellite gears, and a hollow shaft connected to the centers of said satellite gears, said hollow shaft being externally toothed;

first clutch means coupled to said first gearing;

a drive head adapted to be drivingly coupled to the nut, said first clutch means initially coupling said first gearing to said drive head for rotating said drive head at the relatively high speed;

second gearing coupled to said first gearing;

an additional planetary gear reduction stage that forms a part of said second gearing, said hollow shaft providing the sun gear of said additional planetary gear reduction stage;

a high-speed shaft extending concentrically through said hollow shaft;

a low-speed rotating drive means coupled to said second gearing for rotating said drive head at a low speed;

selectively operable means for decoupling said first clutch means and for coupling said low-speed rotating drive means to said drive head;

said first clutch means coupling said hollow shaft to said high-speed shaft; and second clutch means responsive to the predeteremined level of reaction torque for terminating the low-speed driven rotation of said drive head.

2. A machine for driving a nut first at a relatively high speed, and then at a much lower speed but with higher driving torque when a first level of reaction torque in the nut is encountered, said machine comprising:

a power input shaft;

a drive head adapted to be drivingly coupled to the nut;

a high-speed drive train normally drivingly coupled to said power input shaft and having a high-speed output permanently coupled to said drive head for initially rotating the nut at high speed, said high-speed drive train including a first planetary gear reduction stage having a sun gear and satellite gears, and a hollow shaft connected to the centers of said satellite gears, said hollow shaft being externally toothed;

a low-speed drive train coupled to said power input shaft and having a low-speed output;

an additional planetary gear reduction stage that forms a part of said low-speed drive train, said hollow shaft providing the sun gear of said additional planetary gear reduction stage;

an overrunning clutch coupling said low-speed output to said high-speed output such that when said high-speed drive train is operating at high speed said clutch continuously slips, thereby allowing the nut to be rotated at high speed;

a high-speed shaft extending concentrically through said hollow shaft; and said high-speed drive train including friction clutch means coupling said hollow shaft to said high-speed shaft, which, when the nut is rotating at hihg speed, responds to a first level of increased reaction torque for initiating a continuous slipping action such that said low speed output together with said overrunning clutch then drives said high-speed output at low speed and thereby drives said drive head at low speed.

3. A machine as in claim 2 which further includes additional clutch means associated with said low-speed output and responsive to a predetermined second level of reaction torque for terminating the low-speed driven rotation of said drive head.

* * * * *